US009614274B2

(12) United States Patent
Chiu

(10) Patent No.: US 9,614,274 B2
(45) Date of Patent: Apr. 4, 2017

(54) MULTI-ARM TRAP ANTENNA

(71) Applicant: Hung-Hsien Chiu, Hsinchu (TW)

(72) Inventor: Hung-Hsien Chiu, Hsinchu (TW)

( * ) Notice: Subject to any disclaimer, the term of this patent is extended or adjusted under 35 U.S.C. 154(b) by 102 days.

(21) Appl. No.: 14/672,249

(22) Filed: Mar. 30, 2015

(65) Prior Publication Data

US 2016/0294057 A1 Oct. 6, 2016

(51) Int. Cl.

| | |
|---|---|
| ***H01Q 1/38*** | (2006.01) |
| ***H01Q 9/42*** | (2006.01) |
| ***H01Q 5/321*** | (2015.01) |
| *H01Q 5/371* | (2015.01) |

(52) U.S. Cl.

CPC ..... *H01Q 1/38* (2013.01); *H01Q 5/321* (2015.01); *H01Q 9/42* (2013.01); *H01Q 5/371* (2015.01)

(58) Field of Classification Search

CPC .. H01Q 5/10; H01Q 1/38; H01Q 5/00; H01Q 9/04; H01Q 5/0034

USPC ..... 343/749

See application file for complete search history.

(56) References Cited

U.S. PATENT DOCUMENTS

2001/0045908 A1* 11/2001 Keilen ..... H01Q 1/243 343/700 MS
2005/0280579 A1* 12/2005 Liang ..... H01Q 1/38 343/700 MS
2012/0188135 A1* 7/2012 Wong ..... H01Q 1/38 343/749
2013/0249765 A1* 9/2013 Su ..... H01Q 1/243 343/850
2015/0155627 A1* 6/2015 Wong ..... H01Q 5/0034 343/749

* cited by examiner

*Primary Examiner* — Huedung Mancuso
(74) *Attorney, Agent, or Firm* — Leong C. Lei

(57) ABSTRACT

A multi-arm trap antenna for use with a wireless communication device includes at least two arms, each of which includes at least one arm segment; at least one wave trapping assembly, which includes an electrical inductor electrically connecting the arm segments of the arms; a signal feeding element, which electrically connects a radio frequency signal positive to at least one of the arms; and a grounding element, which is electrically connected to a radio frequency signal negative for grounding to form a monopole antenna, or electrically connects the radio frequency signal negative to the arms to which the radio frequency signal positive is electrically connected to form an inverted F-shaped antenna, or electrically connects the radio frequency signal negative to at least one of the arms to form an aperture-coupled antenna. The arms are arranged adjacent to the grounding element in a low-profile bent manner to reduce height.

10 Claims, 20 Drawing Sheets

VSWR - MULTIBAND SINGLE-STRIP MONOPOLE ANTENNA

VSWR - MULTI-ARM TRAP ANTENNA

VSWR - MULTIBAND SINGLE-STRIP MONOPOLE ANTENNA - - - - - - - - -

VSWR - MULTI-ARM TRAP ANTENNA ————————

MULTI-ARM TRAP ANTENNA

TECHNICAL FIELD OF THE INVENTION

The present invention relates generally to an antenna of a wireless communication device, and more particularly to a multi-arm trap antenna.

DESCRIPTION OF THE PRIOR ART

Wireless communication devices are prevailing. Such devices are required to be small, compact, light-weighted, and multifunctional. The space available for accommodating an antenna is increasingly reduced but the bandwidth of the antenna is getting larger. Thus, the techniques of antennas for miniaturization, multiband, and wideband are now in continuous progress to suit the needs of the market of the wireless communication devices.

A conventional multi-frequency antenna design of a wireless communication device involves the application of wave trapping theory, such as Taiwan Patent Publication No. 201044695, which discloses a "multiband single-strip monopole antenna" that achieves a multiband operation through the application of wave trapping theory. However, such a design does not suit the needs of wideband for an antenna.

Using a three-dimensional structure to achieve a multi-frequency or wide band operation is also available, such as Taiwan Patent Publication No. 200929688, which discloses a "multiband antenna". However, such an antenna design requires the antenna itself to occupy a large amount of space, making it impossible for effective utilization of space for installation of other components. To meet the needs of miniaturization, multiband, and wideband for an antenna of a wireless communication device, it is desired to provide an improved antenna for a wireless communication device.

SUMMARY OF THE INVENTION

An object of the present invention is to provide a multi-arm trap antenna that has the characteristics of miniaturization, multiband, and wideband.

To achieve the above object, the present invention provides a multi-arm trap antenna, which comprises: at least two arms, wherein the arms each comprise at least one arm segment; at least one wave trapping assembly, wherein the wave trapping assembly comprises an electrical inductor element electrically connecting the arm segments of the arms; a signal feeding element, which electrically connects a radio frequency signal positive to at least one the arms; a grounding element, which is electrically connected to a radio frequency signal negative for grounding to form a monopole antenna, or electrically connects the radio frequency signal negative to the arms to which the radio frequency signal positive is electrically connected to form an inverted F-shaped antenna, or electrically connects the radio frequency signal negative to at least one of the arms to form an aperture-coupled antenna.

The arms are arranged adjacent to the grounding element in a low-profile bent manner to reduce the height of the antenna so as to enable the multi-arm trap antenna to be adaptive to a small space of a wireless communication device.

In the multi-arm trap antenna according to the present invention, the arm segments are formed so that lengths, widths, and shapes are adjustable according to requirements for characteristics and space and are formed with an etching, printing, or optical manufacturing process and are electrically connected through the wave trapping assembly to form a continuous trace.

In the multi-arm trap antenna according to the present invention, the electrical inductor element of the wave trapping assembly can be a lumped circuit element or can be an element formed through an etching, printing, or optical manufacturing process.

In the multi-arm trap antenna according to the present invention, the wave trapping assembly included in the arms may adjust the capacitance increased by the shortening of the antenna length. The characteristics of the wave trapping assembly that it behaviors like shorting in a low frequency and also behaviors like open-circuiting in a high frequency is used for applications in various antenna configurations, including monopole antenna, inverted F-shaped antenna, aperture-coupled antenna, to provide the multi-arm trap antenna with characteristics of miniaturization, multiband, and wideband.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
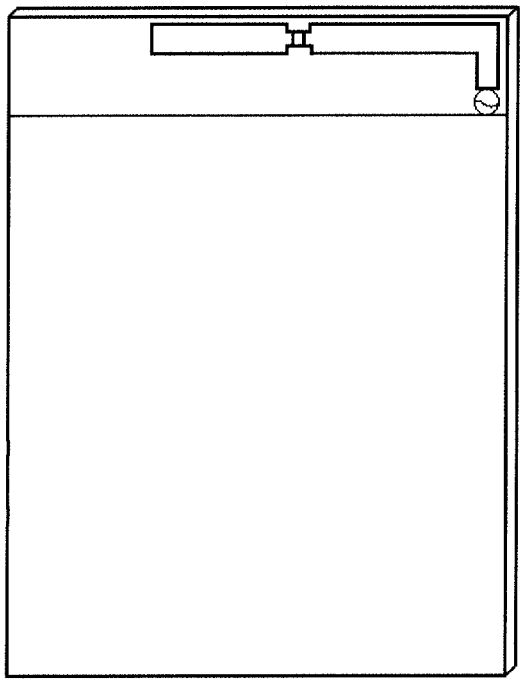
PRIOR ART FIG. 1
FIG. 1 shows a conventional multiband single-strip monopole antenna disclosed in Taiwan Patent Publication No. 201044695.
Figure 2:
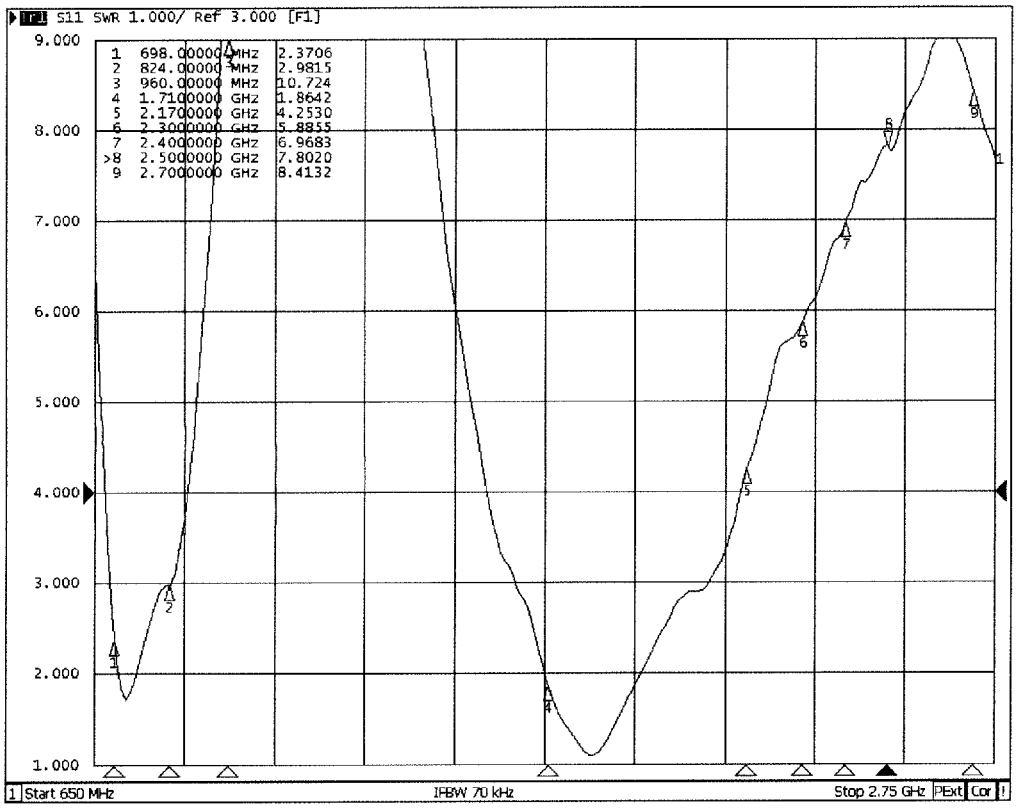
PRIOR ART FIG. 2
FIG. 2 shows a VSWR (Voltage Standing Wave Ratio) curve of the multiband single-strip monopole antenna illustrated in FIG. 1.
Figure 3:
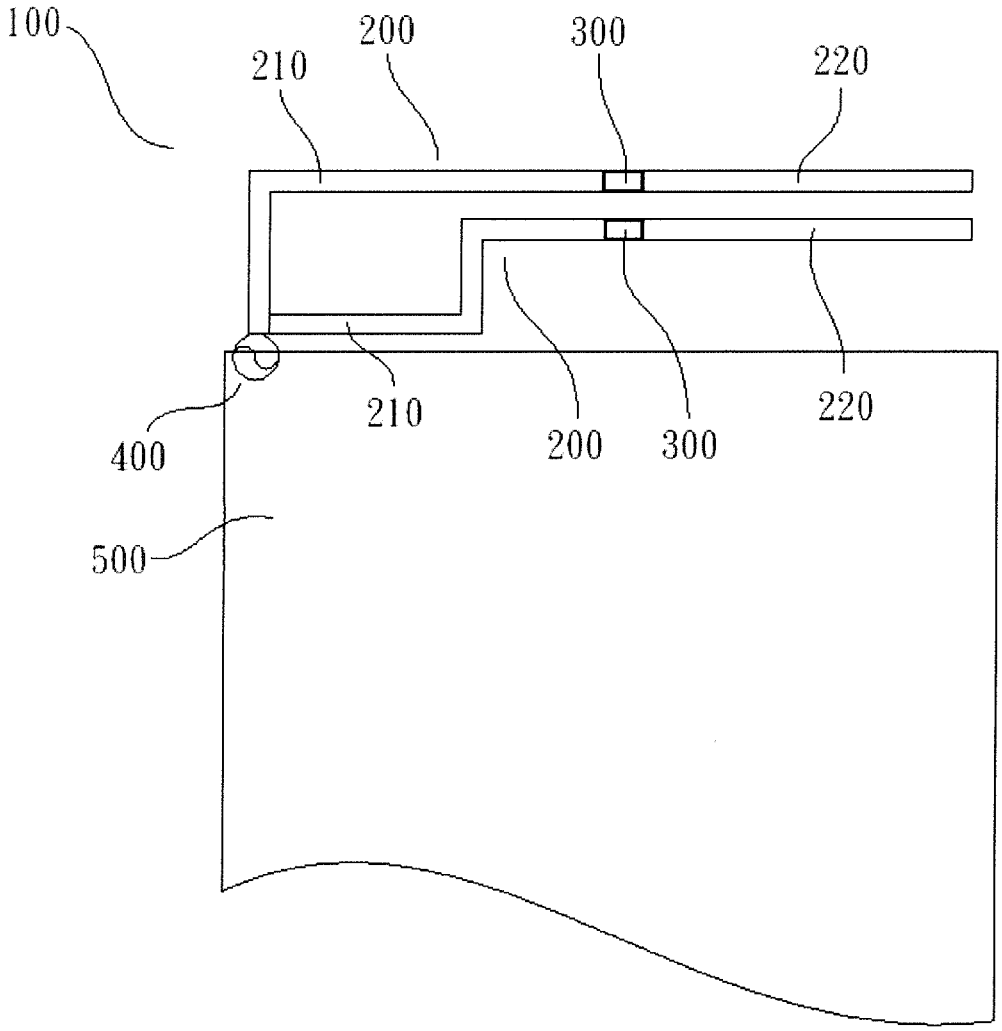
FIG. 3 is a schematic view showing a monopole antenna according an embodiment of the present invention.

Referring to FIG. 3, the present invention provides a multi-arm trap antenna 100, which comprises: two arms 200, wherein each of the arms 200 comprises arm segments 210, 220; two wave trapping assemblies 300, wherein each of the wave trapping assemblies 300 comprises an electrical inductor element electrically connecting the arm segments 210, 220 of the arms 200; a signal feeding element 400, which can be an RF (Radio Frequency) connector, a metallic spring plate, a coaxial cable, or a microstrip line for electrically connecting a radio frequency signal positive to the two arms 200, wherein for easy operation, the two arm segments 210 can be electrically connected in advance through an etching, printing, or optical manufacturing process; a grounding element 500, which is electrically connected to a radio frequency signal negative to provide grounding for forming an monopole antenna. The arm segments 210, 220 can be formed so that lengths, widths, and shapes thereof are adjustable according to the requirement in respect of characteristics and space and can be formed with an etching, printing, or optical manufacturing process and are electrically connected through the wave trapping assemblies 300 to form a continuous trace and laid adjacent to the grounding element 500 in a low-profile bent manner to reduce the height of the antenna. The trace of the arm segments 210 functions for resonating a high frequency, while the total length of the arm segments 210 and 220 resonate a low frequency.

Figure 7:
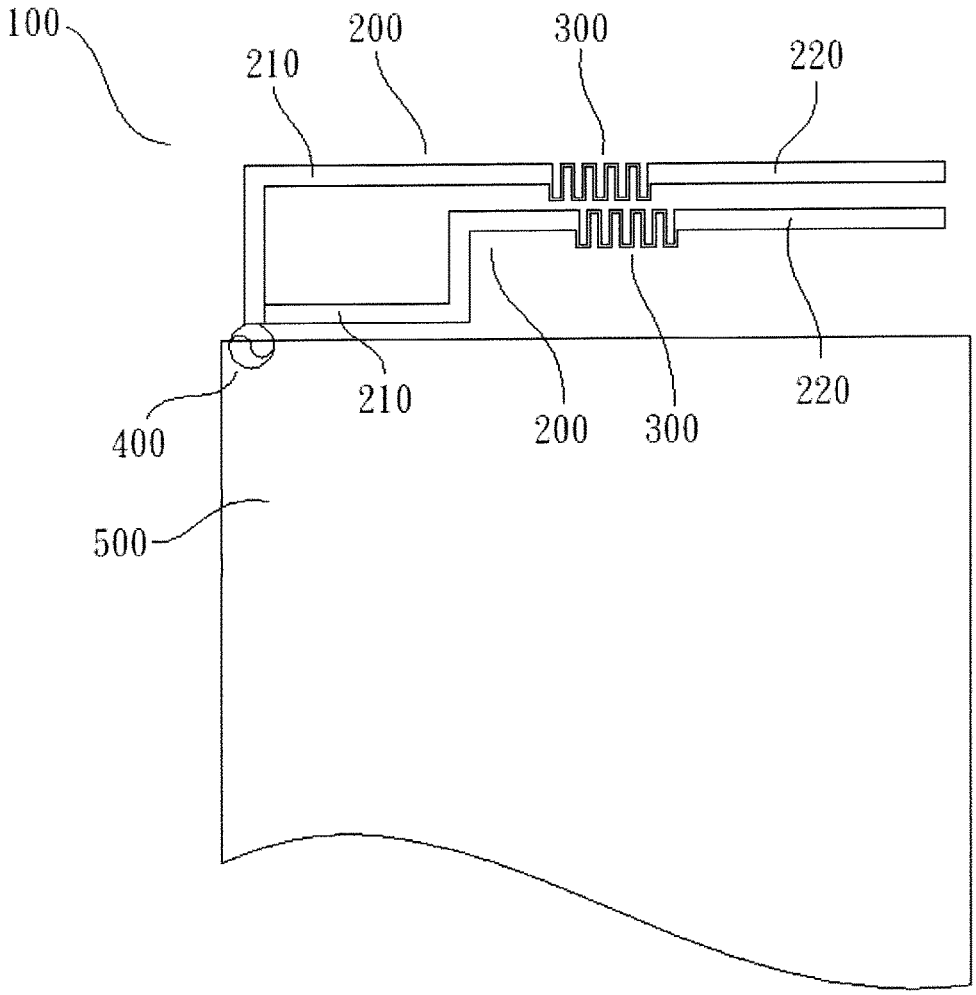
FIG. 7 is a schematic view illustrating an electric inductor of a wave trapping assembly of the monopole antenna of an embodiment of the present invention manufactured with an etching, printing, or optical process.

Referring to FIG. 7, an embodiment of a multi-arm trap monopole antenna is shown. The multi-arm trap antenna 100 comprises two arms 200 and two wave trapping assemblies 300. The wave trapping assemblies 300 each comprise an electrical inductor element. The electrical inductor element comprises an inductor that is formed through an etching, printing, or optical manufacturing process and is electrically connected to the arm segments 210, 220 of each of the arms 200 to form a monopole antenna.

Figure 8:
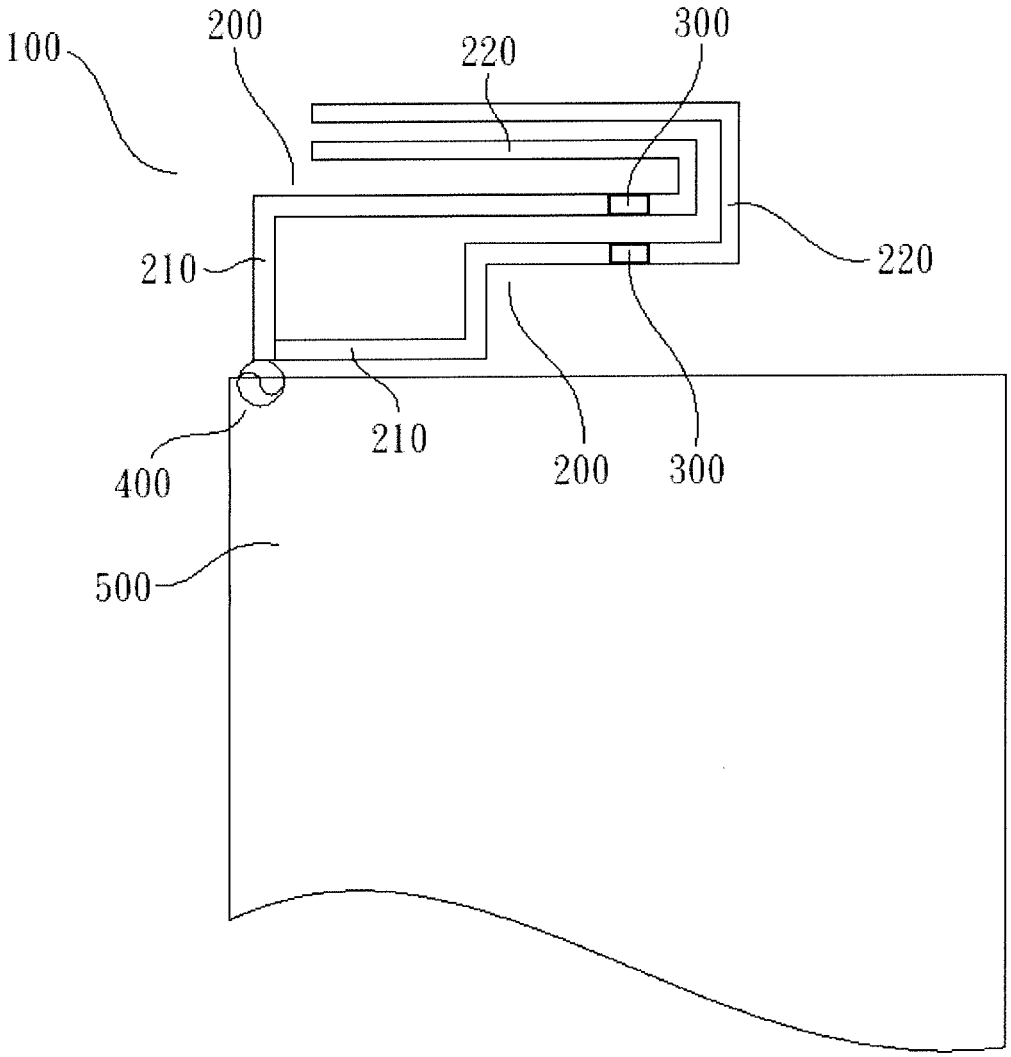
FIG. 8 is a schematic view illustrating a chip inductor included in a wave trapping assembly of the monopole antenna of an embodiment of the present invention.

Referring to FIG. 8, an embodiment of a multi-arm trap monopole antenna is shown. The multi-arm trap antenna 100 comprises two arms 200 and two wave trapping assemblies 300. The wave trapping assemblies 300 each comprise an electrical inductor element. The electrical inductor element comprises a chip inductor electrically connected to the arm segments 210, 220 of each of the arms 200 to form a monopole antenna.

Figure 9:
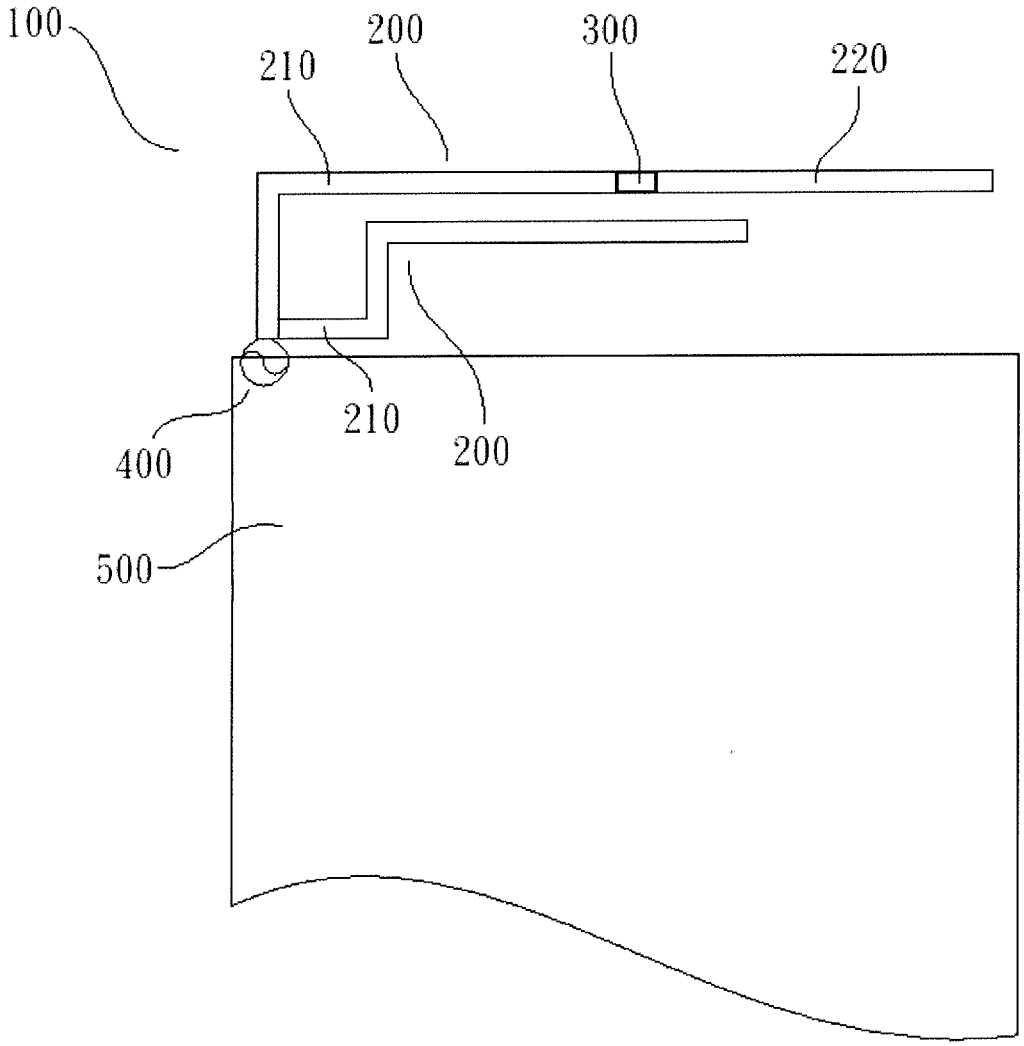
FIG. 9 is a schematic view showing a monopole antenna according to an embodiment of the present invention comprising arms of which a portion have a single arm segment.

Referring to FIG. 9, an embodiment of a multi-arm trap monopole antenna is shown. The multi-arm trap antenna 100 comprises two arms 200 (of which one of the arms 200 comprises a single arm segment 210 so that the trace resonates with another individual frequency) and a wave trapping assembly 300. The wave trapping assembly 300 comprises an electrical inductor element. The electrical inductor element comprises a chip inductor electrically connected to the arm segments 210, 220 of the arm 200 to form a monopole antenna.

Figure 10:
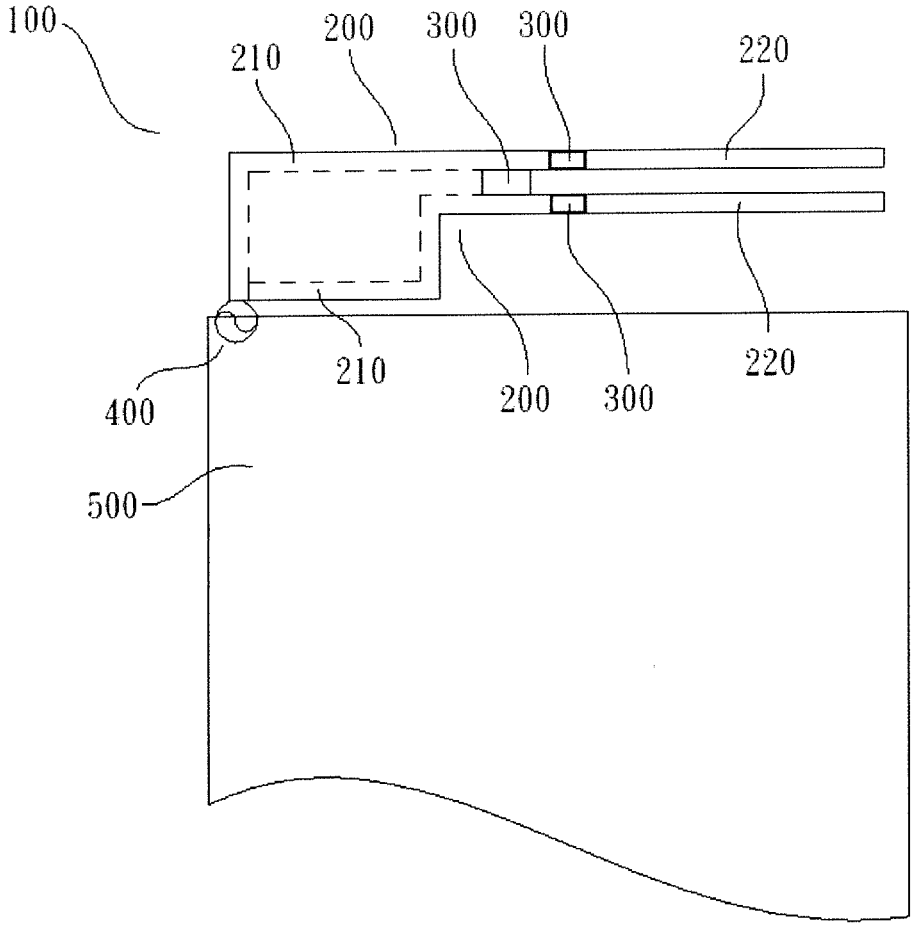
FIG. 10 is a schematic view showing a monopole antenna of an embodiment of the present invention comprising arms that are electrically connected by a wave trapping assembly, wherein the area delimited by phantom lines is available for laying of a conductive material therein.

Referring to FIG. 10, an embodiment of a multi-arm trap monopole antenna is shown. The multi-arm trap antenna 100 comprises two arms 200 and three wave trapping assemblies 300. The wave trapping assemblies 300 each comprise an electrical inductor element, wherein two wave trapping assemblies 300 are respectively and electrically connected to the arm segments 210, 220 of the arms 200 and one wave trapping assembly 300 comprises a conductor inductor electrically connected between the two arms 200 for adjustment of impedance. In the drawing, the area delimited by phantom lines may receive a conductive material laid therein to form a monopole antenna.

Figure 11:
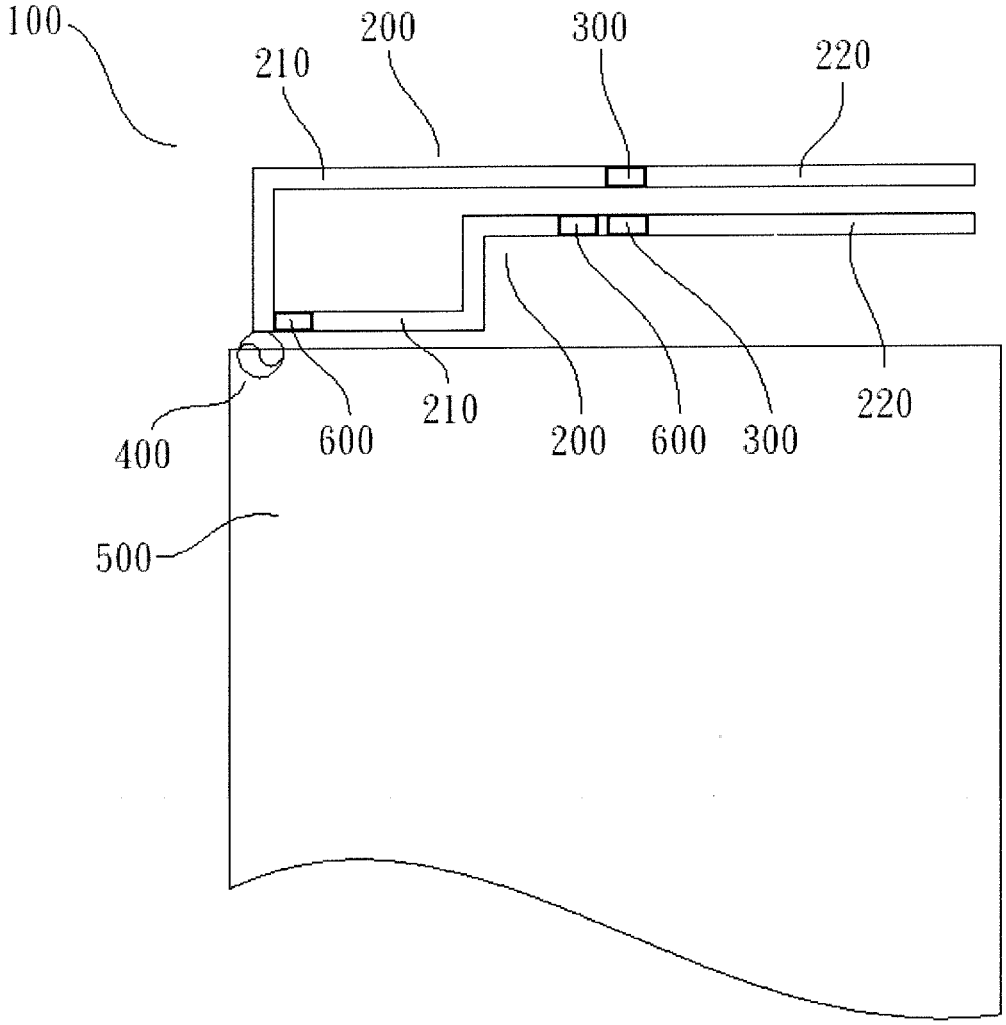
FIGS. 11 and 12 are schematic views illustrating a monopole antenna of an embodiment of the present invention that is switchable between arms with a switch diode.

Referring to FIG. 11, an embodiment of a multi-arm trap monopole antenna is shown. The multi-arm trap antenna 100 comprises two arms 200 and two wave trapping assemblies 300 and also comprises a switch formed of a diode 600 for switching the arms 200 to adjust the band width so as to form a monopole antenna.

Figure 12:
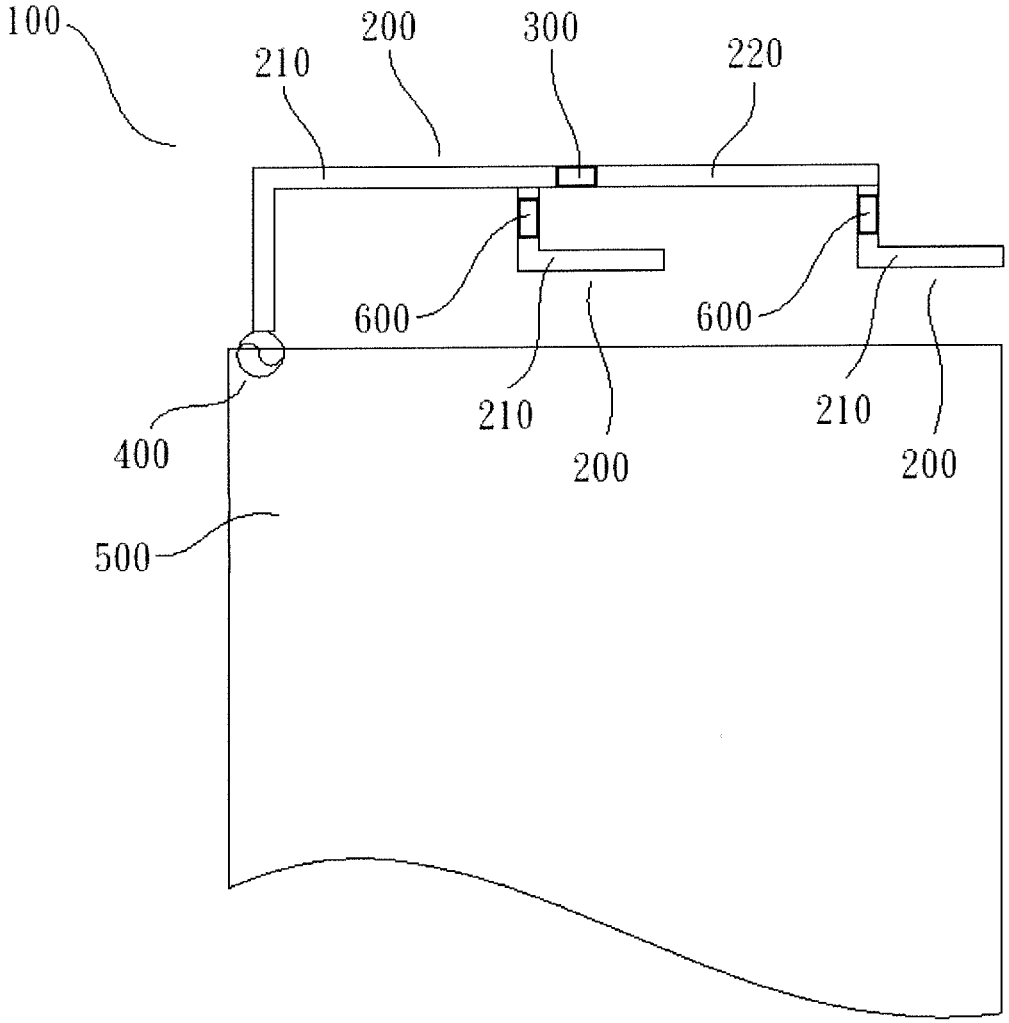

Referring to FIG. 12, an embodiment of a multi-arm trap monopole antenna is shown. The multi-arm trap antenna 100 comprises three arms 200 (of which two arms 200 each comprise a single arm segment 210) and a wave trapping assembly 300 and further comprises switches of diodes 600 for switching the arms 200 to adjust the band width so as to form a monopole antenna.

Figure 13:
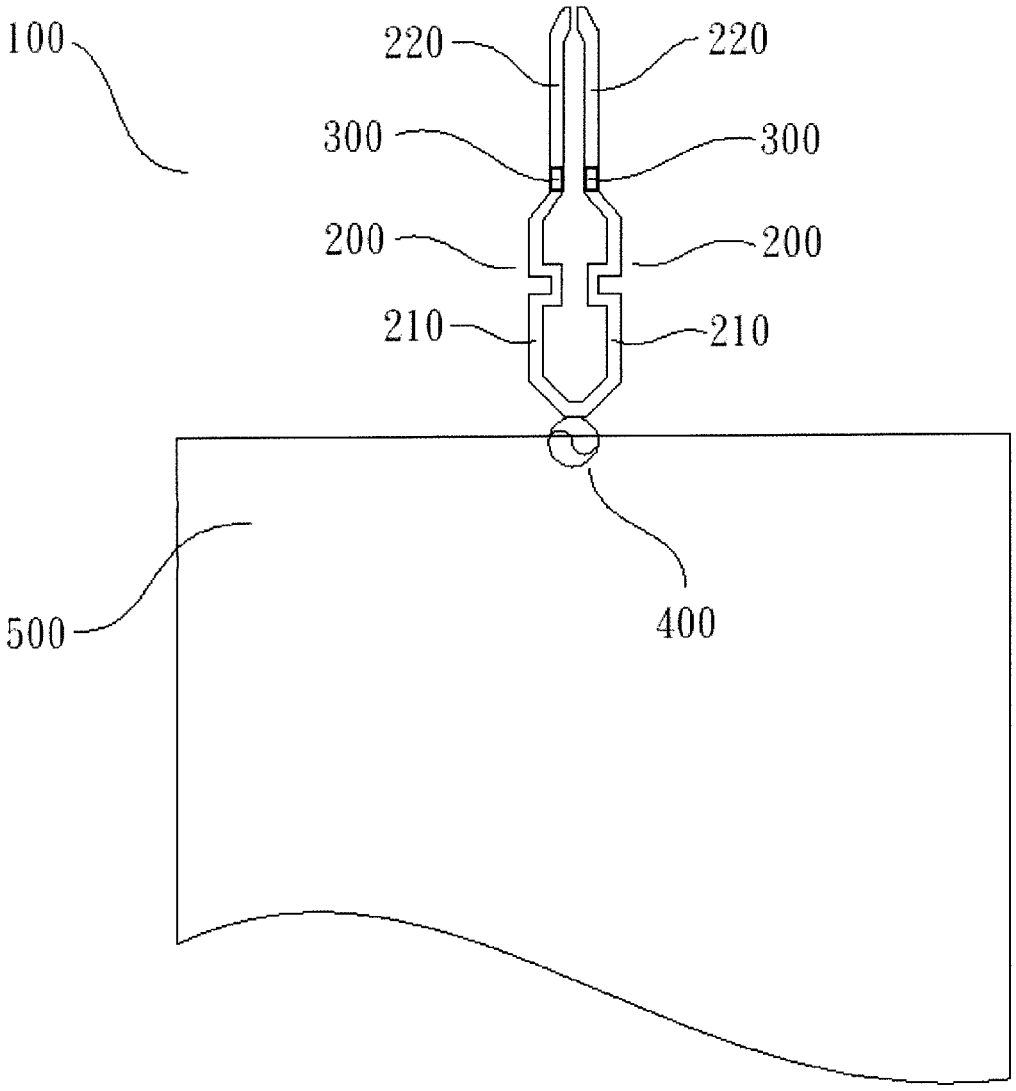
FIG. 13 is a schematic view showing a monopole antenna of an embodiment of the present invention that has arms that are bent to reduce height.

Referring to FIG. 13, an embodiment of a multi-arm trap monopole antenna is shown. The multi-arm trap antenna 100 comprises two arms 200 and two wave trapping assemblies 300. The arms 200 are bent to different angles according to requirements to reduce the height. The wave trapping assemblies 300 each comprise an electrical inductor element. The electrical inductor element comprises a chip inductor electrically connected to the arm segments 210, 220 of each of the arms 200 to form a monopole antenna.

Figure 14:
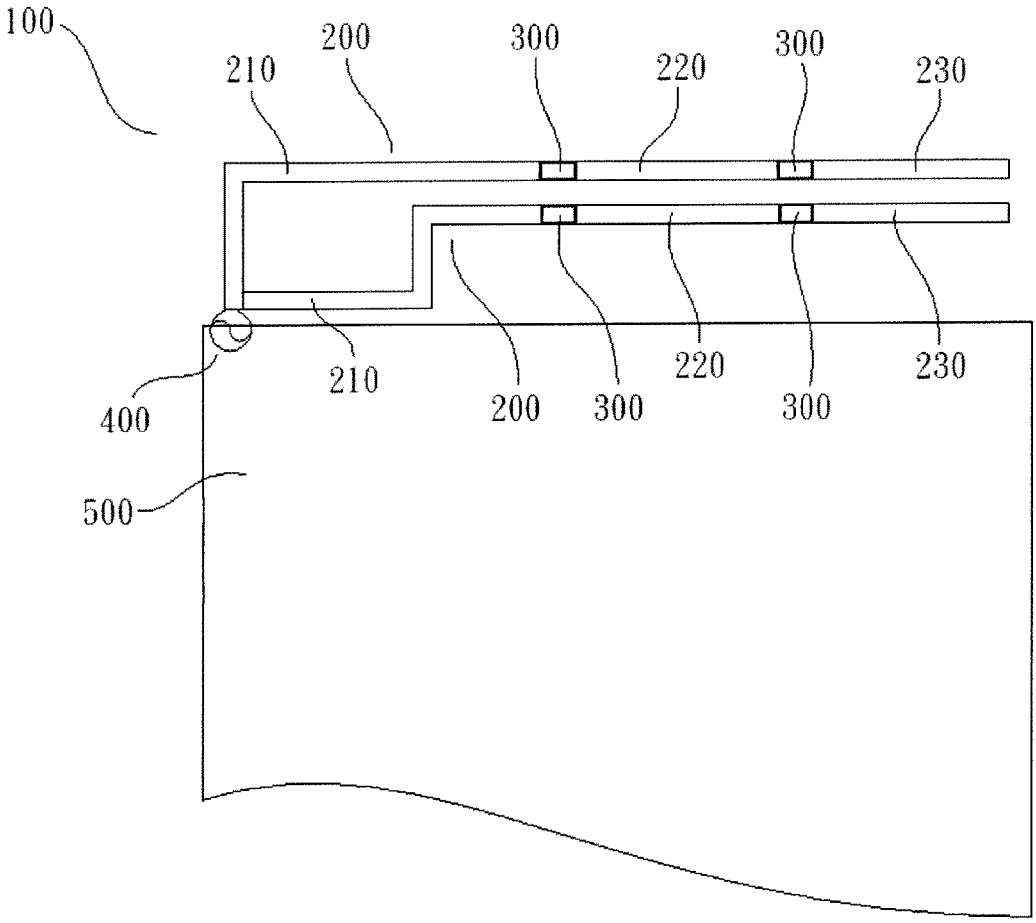
FIGS. 14 and 15 are schematic views illustrating a monopole antenna of an embodiment of the present invention having multiple wave trapping assemblies.

Referring to FIG. 14, an embodiment of a multi-arm trap monopole antenna is shown. The multi-arm trap antenna 100 comprises two arms 200 and four wave trapping assemblies 300. The wave trapping assemblies 300 each comprise an electrical inductor element. The electrical inductor element comprises a chip inductor electrically connected to the arm segments 210, 220, 230 of each of the arms 200 to form a monopole antenna.

Figure 15:
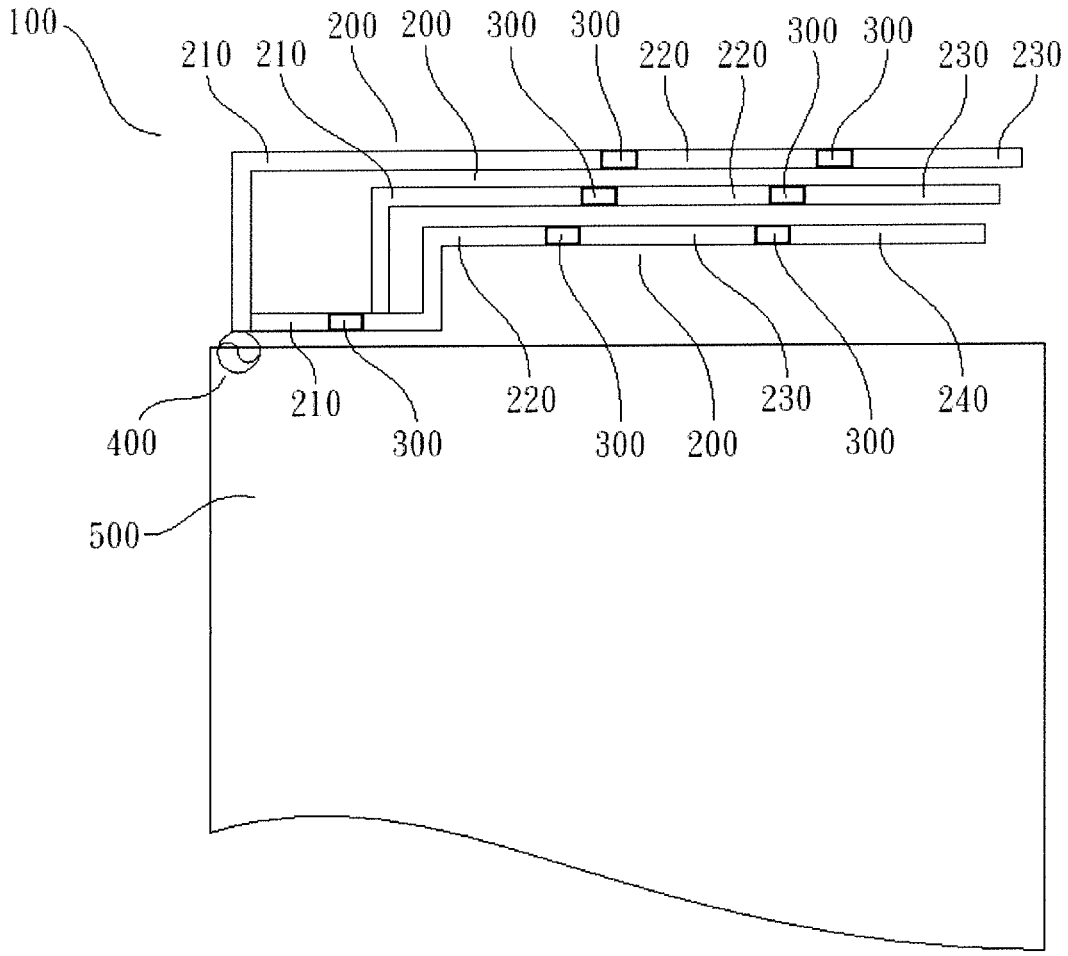

Referring to FIG. 15, an embodiment of a multi-arm trap monopole antenna is shown. The multi-arm trap antenna 100 comprises three arms 200 and seven wave trapping assemblies 300. The wave trapping assemblies 300 each comprises an electrical inductor element. The electrical inductor element comprises a chip inductor electrically connected to the arm segments 210, 220, 230, 240 of each of the arms 200 to form a monopole antenna.

Figure 16:
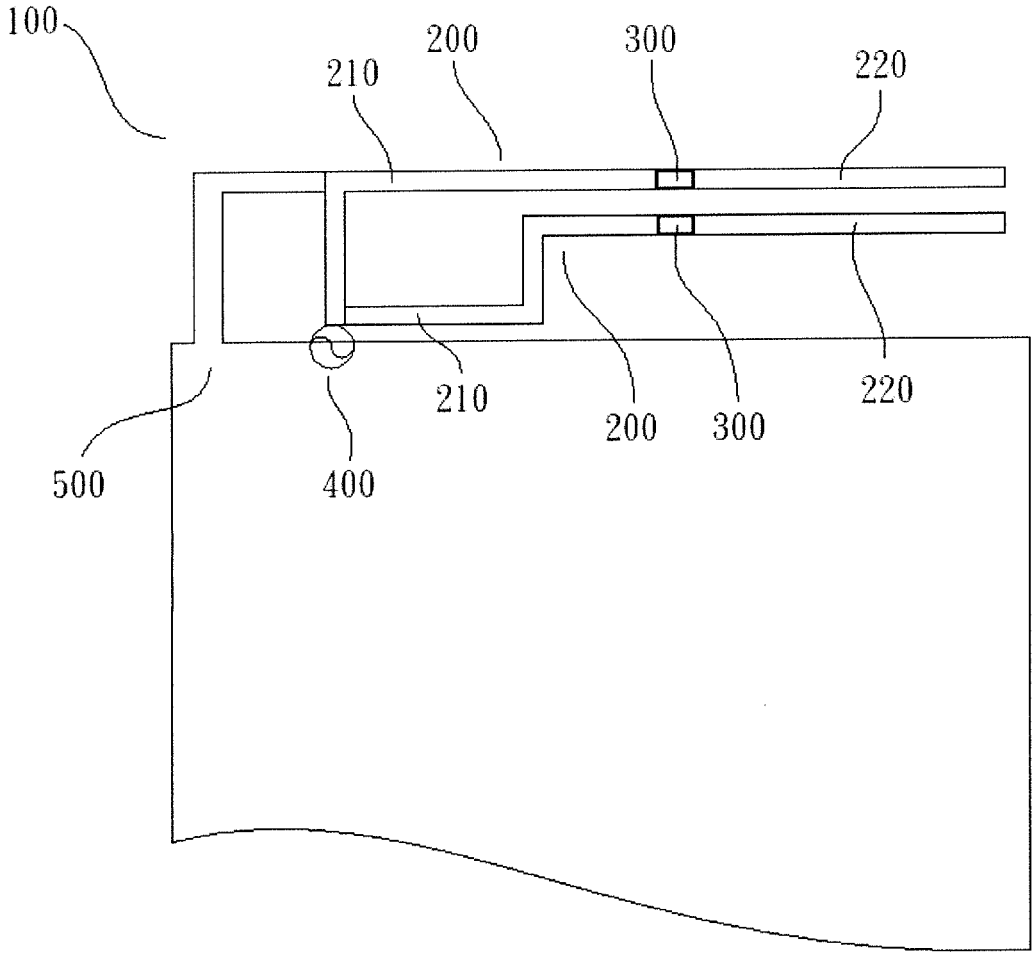
FIG. 16 is a schematic view illustrating an inverted F-shaped antenna according to an embodiment of the present invention.

Referring to FIG. 16, an embodiment of a multi-arm trap antenna is shown. The multi-arm trap antenna 100 is similar to the embodiment illustrated in FIG. 3 and the general difference is that a grounding element 500 is arranged to electrically connect a radio frequency signal negative to the arms 200 to which a radio frequency signal positive is electrically connected to form an inverted F-shaped antenna. Drawings for other embodiments associated with the multi-arm trap inverted F-shaped antenna may refer the drawings and descriptions of the other embodiments associated with the multi-arm trap monopole antenna. Further, the grounding element 500 electrically connects a radio frequency signal negative to the arms 200 to which a radio frequency signal positive is electrically connected to form a multi-arm trap inverted F-shaped antenna. The trace of the arm segments 210 resonates a high frequency and the total length of the trace of the arm segments 210 and 220 resonates a low frequency.

Figure 17:
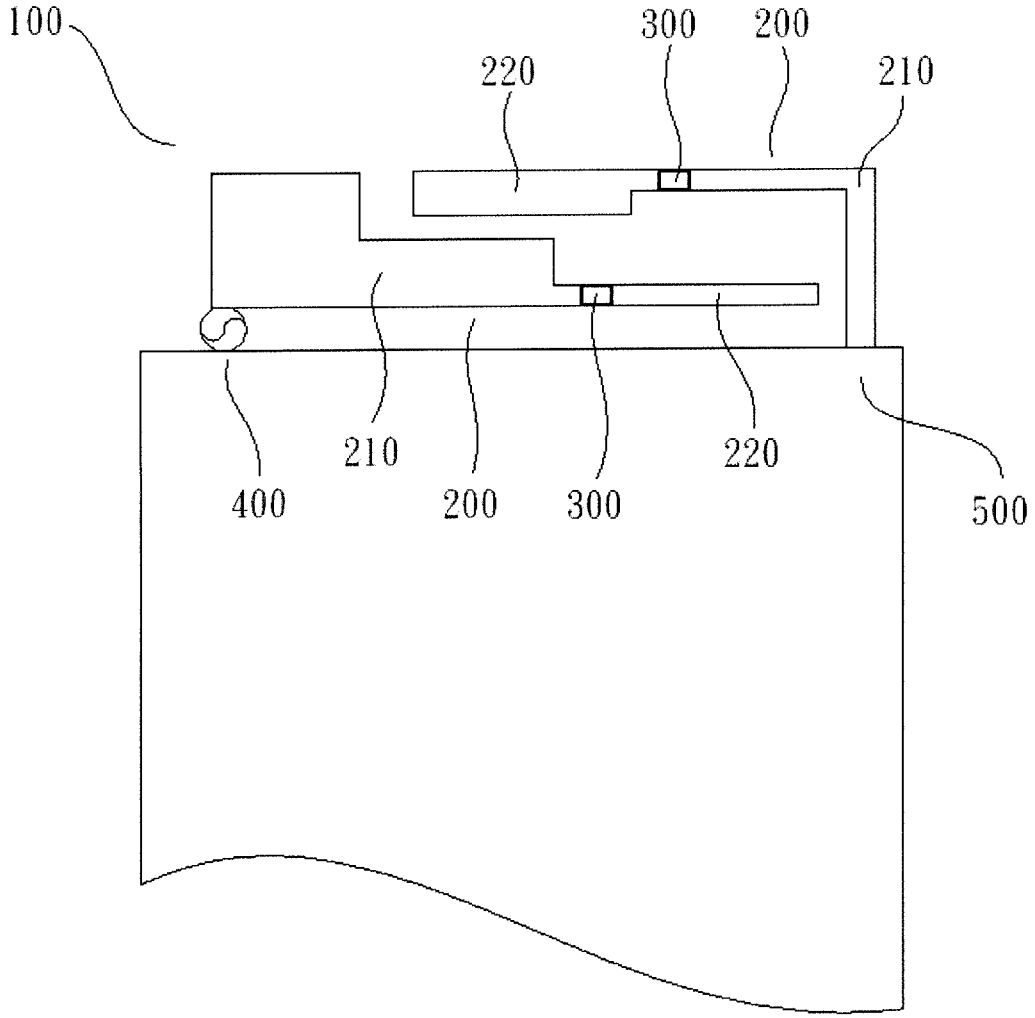
FIG. 17 is a schematic view illustrating an aperture-coupled antenna according to an embodiment of the present invention.

Referring to FIG. 17, an embodiment of a multi-arm trap antenna is shown. The multi-arm trap antenna 100 comprises: two arms 200, wherein the arms 200 each comprise arm segments 210, 220; two wave trapping assemblies 300, wherein the wave trapping assemblies 300 each comprise an electrical inductor element electrically connecting the arm segments 210, 220 of each of the arms 200; a signal feeding element 400, which can be an RF connector, a metallic spring plate, a coaxial cable, or a microstrip line for electrically connecting a radio frequency signal positive to one of the arms 200; a grounding element 500, which electrically connects a radio frequency signal negative to one of the arms 200 to form an aperture-coupled antenna 100. The arm segments 210, 220 can be formed so that lengths, widths, and shapes thereof are adjustable according to the requirement in respect of characteristics and space and can be formed with an etching, printing, or optical manufacturing process and are electrically connected through the wave trapping assemblies 300 to form a continuous trace and laid adjacent to the grounding element 500 in a low-profile bent manner to reduce the height of the antenna. The trace of the arm segments 210 functions for resonating a high frequency, while the total length of the arm segments 210 and 220 resonate a low frequency.

Figure 18:
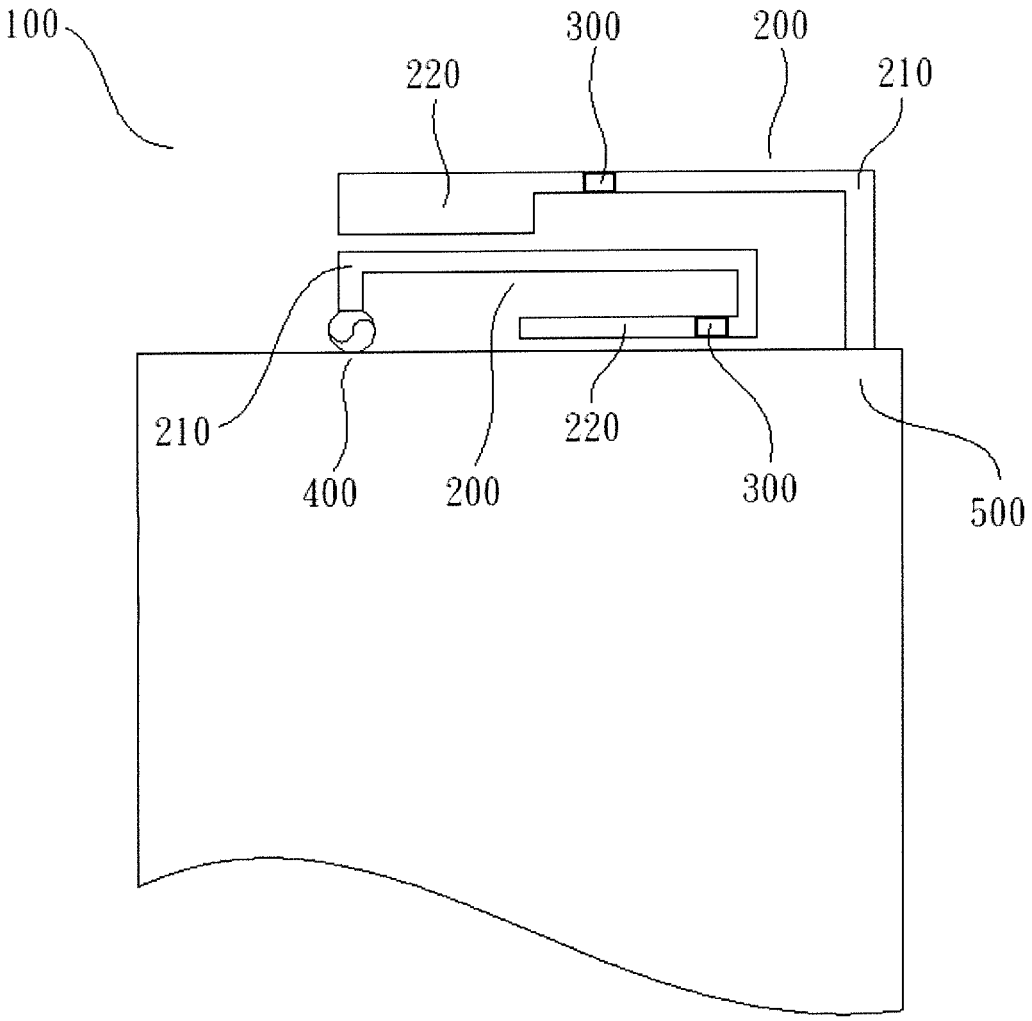
FIG. 18 is a schematic view illustrating an aperture-coupled antenna having an arm bent to reduce the size.

Referring to FIG. 18, an embodiment of a multi-arm trap aperture-coupled antenna is shown. The multi-arm trap antenna 100 comprises two arms 200 (of which one of the arms 200 is bent to reduce the size) and two wave trapping assemblies 300 to form an aperture-coupled antenna.

Figure 19:
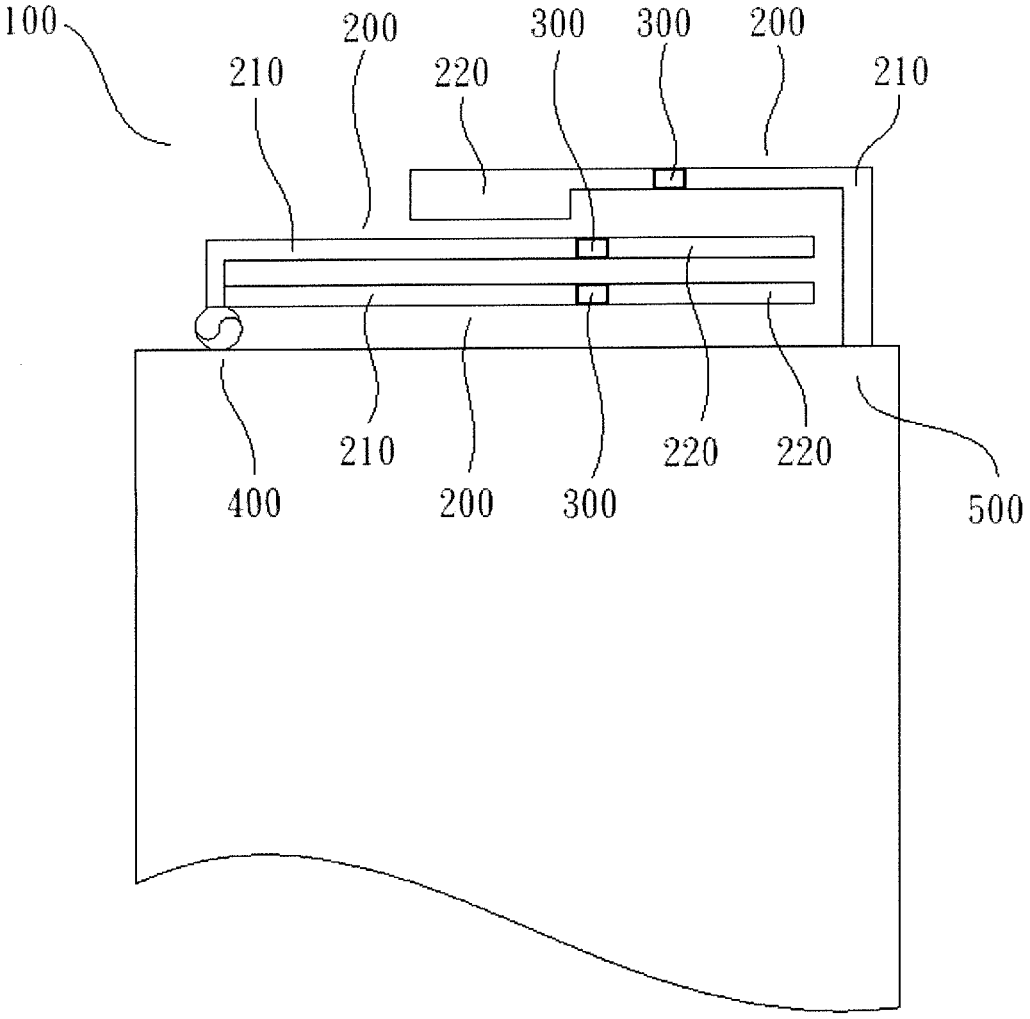
FIG. 19 is a schematic view illustrating an aperture-coupled antenna having three arms.

Referring to FIG. 19, an embodiment of a multi-arm trap aperture-coupled antenna is shown. The multi-arm trap antenna 100 comprises three arms 200 and three wave trapping assemblies 300 to form an aperture-coupled antenna.

Figure 20:
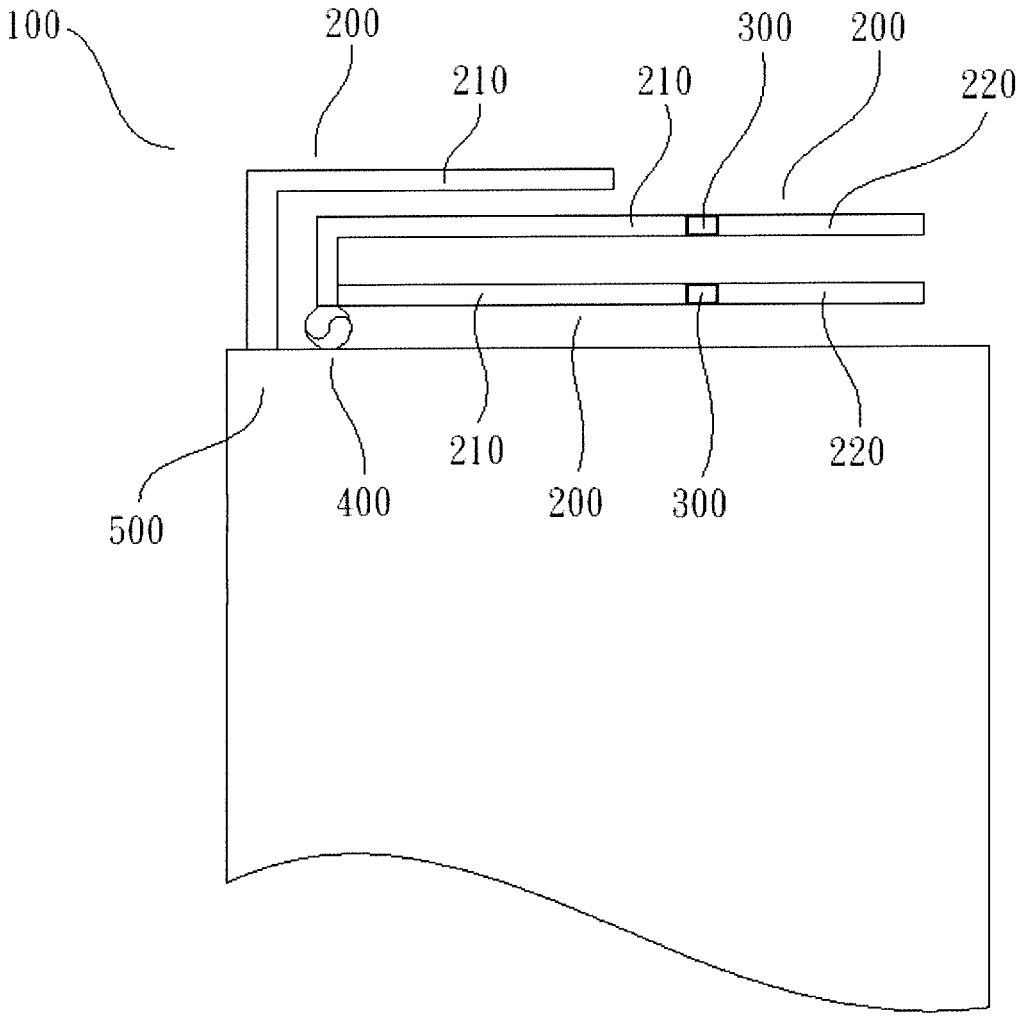
FIG. 20 is a schematic view illustrating an aperture-coupled antenna that comprises arms of which a portion has a single arm segment.

Referring to FIG. 20, an embodiment of a multi-arm trap aperture-coupled antenna is shown. The multi-arm trap antenna 100 comprises three arms 200 (of which one of the arms 200 comprises a single arm segments 210) and two wave trapping assemblies 300 to form an aperture-coupled antenna.

The ways of embodying the arms 200, the wave trapping assemblies 300, and the diode 600 of the above-described embodiments of the multi-arm trap monopole antenna are also applicable to the above-described multi-arm trap inverted F-shaped antenna and multi-arm trap aperture-coupled antenna.

Figure 4:
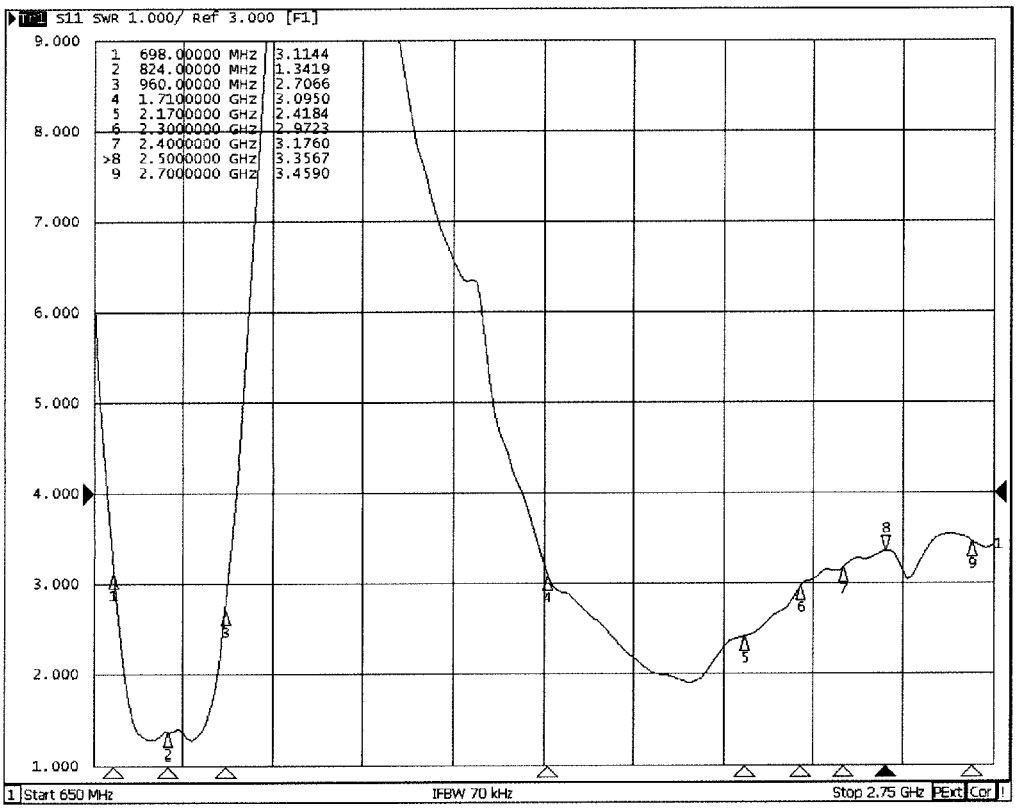
FIG. 4 shows a VWSR curve of the monopole antenna of an embodiment of the present invention shown in FIG. 3.
Figure 5:
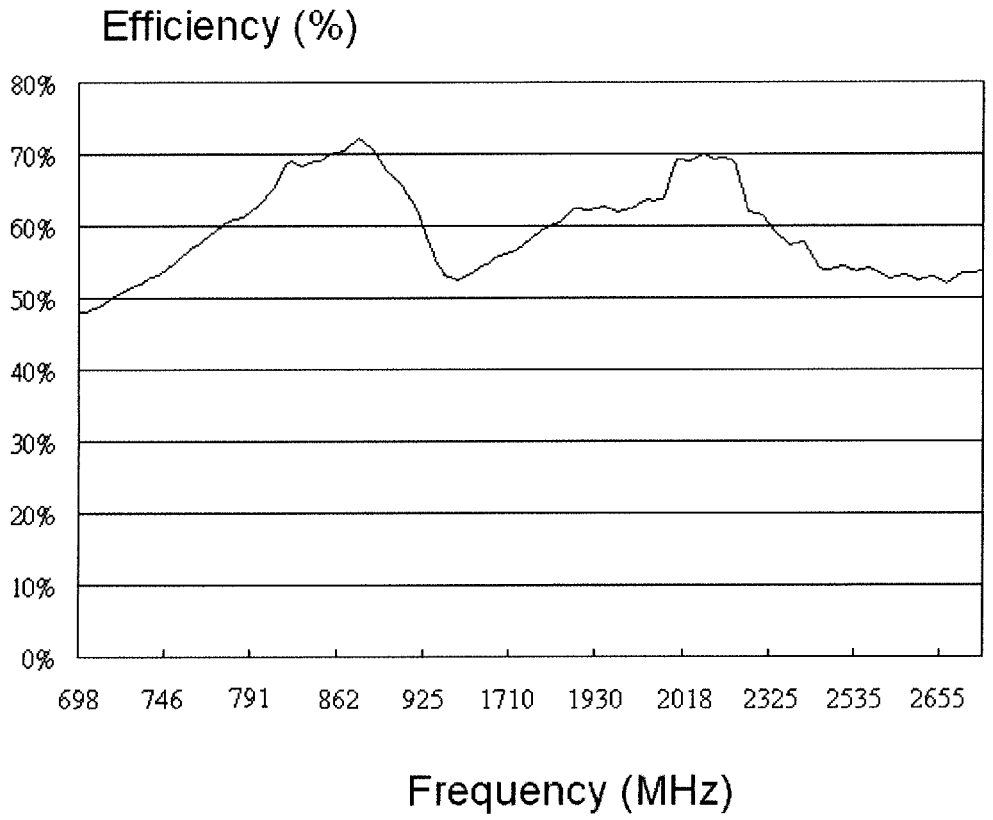
FIG. 5 shows a plot of radiation efficiency of the monopole antenna of an embodiment of the present invention shown in FIG. 3.
Figure 6:
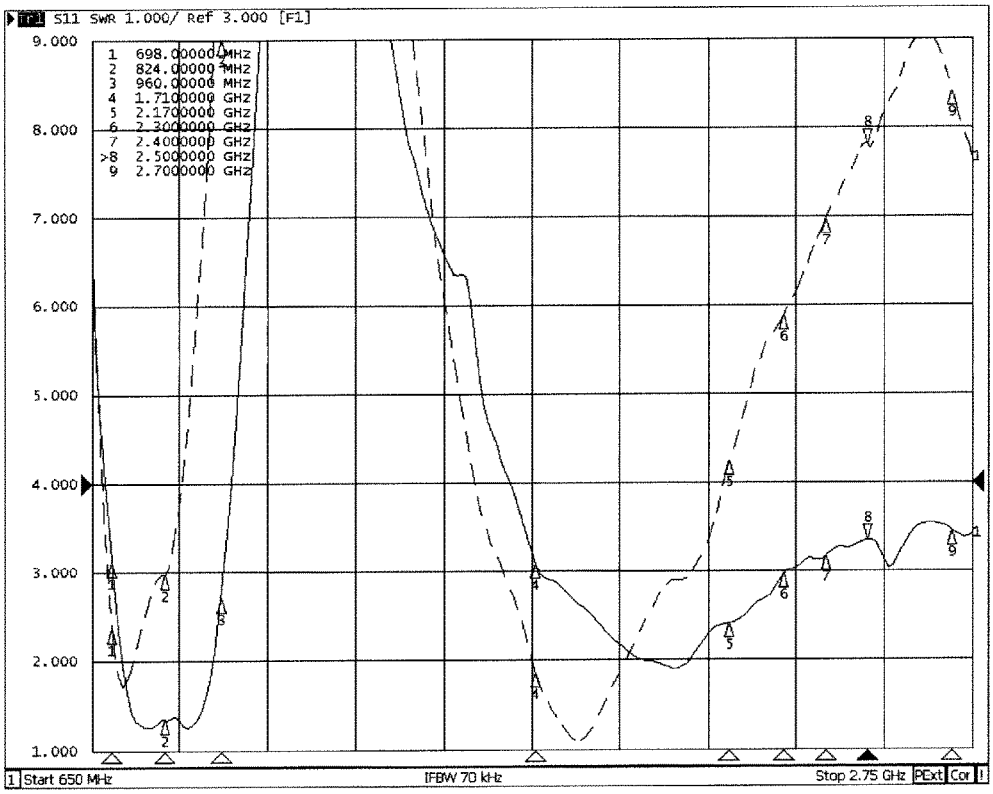
FIG. 6 shows a comparison between the VSWR curve of the conventional multiband single-strip monopole antenna illustrated in FIG. 2 and the VSWR cure of the monopole antenna of an embodiment of the present invention illustrated in FIG. 4.

As shown in the plots of curves illustrated in FIGS. 4-6, comparison of the operation and performance of the present invention is given. These plots provide data that reveal the fact that the present invention achieves the effects of miniaturization, multiband, and wideband of a multi-arm trap antenna and provides a structural arrangement that has not been disclosed or proposed before.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A multi-arm trap antenna, comprising:

at least two arms, wherein each of the arms comprises at least one arm segment and each of the arms has a free end, the free ends of the arms being separate from each other;

at least one wave trapping assembly, wherein the wave trapping assembly comprises an electrical inductor element and the wave trapping assembly is electrically connected between the arm segments of at least one of the arms;

a signal feeding element, which electrically connects a radio frequency signal positive to a root end of at least one of the arms that is opposite to the free end; and a grounding element, which is electrically connected to a radio frequency signal negative of the signal feeding element;

wherein the arms are arranged adjacent to the grounding element in a low-profile bent manner to reduce a height of the multi-arm trap antenna.

2. The multi-arm trap antenna according to claim 1, wherein the arm segments of the arms are formed so that lengths, widths, and shapes are adjustable according to requirements for characteristics and space and the arm segments of the arms are formed with one of an etching process, a printing process, and an optical manufacturing process.

3. The multi-arm trap antenna according to claim 1, wherein the electrical inductor element of the wave trapping assembly comprises a chip inductor.

4. The multi-arm trap antenna according to claim 1, wherein the electrical inductor element of the wave trapping assembly is formed with one of an etching process, a printing process, and an optical manufacturing process.

5. The multi-arm trap antenna according to claim 1, wherein the arms electrically connected through the wave trapping assembly.

6. The multi-arm trap antenna according to claim 1, wherein the arms are electrically connected to through a conductor line and the arms delimit an area therebetween to receive a conductive material laid therein.

7. The multi-arm trap antenna according to claim 1, wherein the arms are switchable through a diode switch for adjusting band width and frequency.

8. The multi-arm trap antenna according to claim 1, wherein the grounding element is electrically connected to the radio frequency signal negative for grounding to form a monopole antenna.

9. The multi-arm trap antenna according to claim 1, wherein the grounding element electrically connects the radio frequency signal negative to the arms to which the radio frequency signal positive is electrically connected to form an inverted F-shaped antenna.

10. The multi-arm trap antenna according to claim 1, wherein the grounding element electrically connects the radio frequency signal negative to at least one the arms to form an aperture-coupled antenna.

* * * * *